US005194705A

United States Patent [19]

Canault

[11] Patent Number: 5,194,705

[45] Date of Patent: Mar. 16, 1993

[54] ADAPTATION DEVICE EFFECTING MECHANICAL COUPLING BETWEEN A CONTACTOR AND AUXILIARY SWITCHES HAVING DIFFERENT WORKING STROKES

[75] Inventor: Jean Canault, Orvaux, France

[73] Assignee: Telemecanique, France

[21] Appl. No.: 619,549

[22] Filed: Nov. 29, 1990

[30] Foreign Application Priority Data

Dec. 8, 1989 [FR] France ..... 89 17013

[51] Int. Cl.[5] ..... H01H 9/20

[52] U.S. Cl. ..... 200/50 C

[58] Field of Search ..... 200/50 C; 335/159-161, 335/185, 132

[56] References Cited

U.S. PATENT DOCUMENTS 4,896,006 1/1990 Dard et al. ..... 200/17 R 5,012,214 4/1991 Faffart ..... 335/185 X

*Primary Examiner*—J. R. Scott

*Attorney, Agent, or Firm*—William A. Drucker

[57] ABSTRACT

An adapation module is provided for effecting mechanical coupling between a contactor having a movable control member and an auxiliary contact module actuated by an actuating member, which adaptation module is provided with a pivoting lever one end of which is equipped with a groove receiving the movable control member of the contactor whereas the other end is coupled to the actuating member of the auxiliary contact module.

5 Claims, 4 Drawing Sheets

ADAPTATION DEVICE EFFECTING MECHANICAL COUPLING BETWEEN A CONTACTOR AND AUXILIARY SWITCHES HAVING DIFFERENT WORKING STROKES

BACKGROUND OF THE INVENTION

1. Field of the Invention

The invention relates to an adaptation device placed between any one of a multiplicity of contactor apparatus having coupling members with different working strokes and auxiliary switches. The auxiliary switches have contact mobile parts travelling over a working stroke less than or equal to those of the contactor coupling members.

2. Description of the Prior Art

A rotary cam device has already been disclosed, for example in the French patent application 87 09342 of the Applicant. The rotation of the cam is transmitted non linearly so as not to reproduce integrally the movements which this device receives.

This device is suitable when, for a given size thereof, certain proportions between the input movement and the output movement must not be exceeded.

To provide suitable arc cut-off, the contactors have to make working strokes which increase with the intensity of the currents passing through their main switches. On the other hand, the working strokes made by the auxiliary switches which ensure electric locking and re-transmit comparable signalling are similar, since the loads that they supply always have closely related characteristics.

It results that these auxiliary switches cannot be coupled directly to the mobile parts of the contactor apparatus with which it is desired to associate them.

A possible solution to this problem consists in supplying a range of auxiliary switch apparatus manufactured to size for the corresponding range of contactors. This solution, however, needlessly increases the different manufacturing and stock management technical costs . . . Furthermore, it also involves the publication in the commercial catalogue and the availability of a set of apparatus whose closely related external shapes risk confusing the user.

SUMMARY OF THE INVENTION

Consequently it is an object of the invention to overcome these drawbacks and to an adaptation coupling device which will make it possible to fit, on any contactor apparatus of a given range of sizes, auxiliary switch apparatus having the minimum size and working strokes required for association thereof with a contactor apparatus whose size is the lowest in the given range.

According to the invention, such an adaptation device includes, in a case having means for indexing its position with respect to that of the body of an associated contactor, a pivotable transmission lever having an arm provided with an S-shaped groove cooperating with the contactor coupling member, said lever further having external coupling claw adapted for cooperating with a movable contact control part belonging to an auxiliary switch apparatus, said groove comprising two non aligned endmost portions and an intermediate connecting portion communicating a rocking movement to said lever in order to impart a predetermined movement on the claw. In practice, said predetermined movement will be obtained for a fraction of the working stroke of the contactor which has the highest working stroke of the range.

According to a preferred embodiment, the coupling claw is accessible from the outside adaptation when the device is associated with the body of the contactor, replacement of the auxiliary switch apparatus then being readily carried out without it being necessary to dismantle the adaptation device.

It is a further object of the invention to widen the functions of the adaptation device by providing it with several levers in order to have two claws thus able to actuate a pair of auxiliary apparatus carrying out separate functions, such for example as the instantaneous or delayed closure and opening of auxiliary contacts.

BRIEF DESCRIPTION OF THE DRAWINGS

The invention will be better understood from the following description and the accompanying drawings wherein.

DESCRIPTION OF THE PREFERRED EMBODIMENTS

Figure 1:
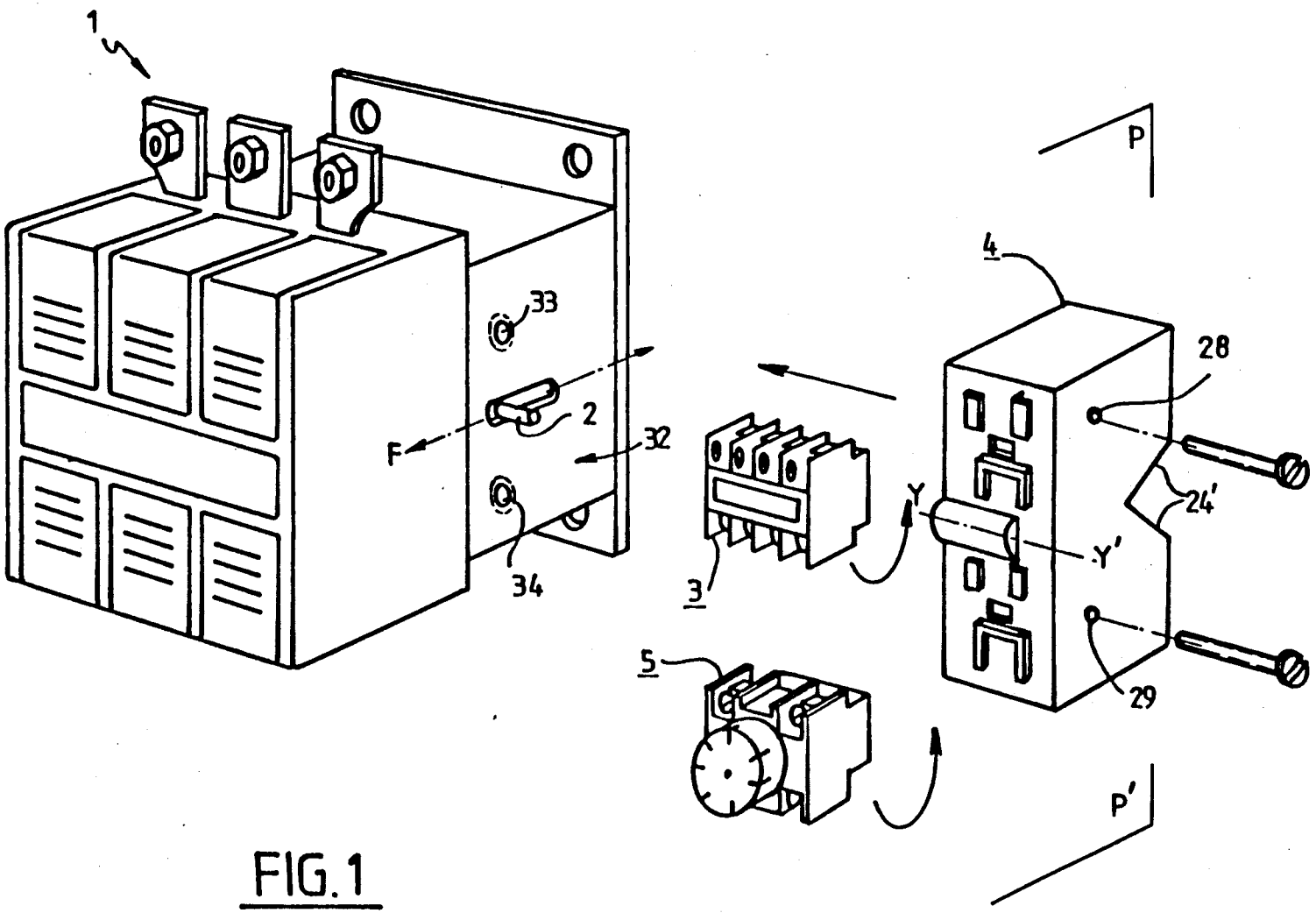
FIG. 1 is an exploded perspective view of a large size contactor and of the adaptation device used for associating auxiliary contact cases therewith.

The large size contactor apparatus 1, shown in FIG. 1, comprises an internal electromagnet whose mobile armature, which is not shown, makes a certain working stroke when it is energized and de-energized. A lateral coupling member such as a pin or stud 2, connected directly or not to this armature, simultaneously makes a substantially rectilinear movement in direction F. This movement is used to cause switching of associated auxiliary switches such as 3 which are, within the scope of the present invention, generally intended to be combined with contactors of smaller sizes. These auxiliary switches, in which the working stroke of the mobile parts is substantially less than the preceding one, could not be coupled to this pin without using an appropriate adaptation device such as 4.

Other types of auxiliary switches such for example as a time delay switch 5 may also be associated with contactor 1 by means of this same adaptation device when their sizes and the working strokes of their mobile parts were initially designed for association with a smaller size contactor.

Figure 3:
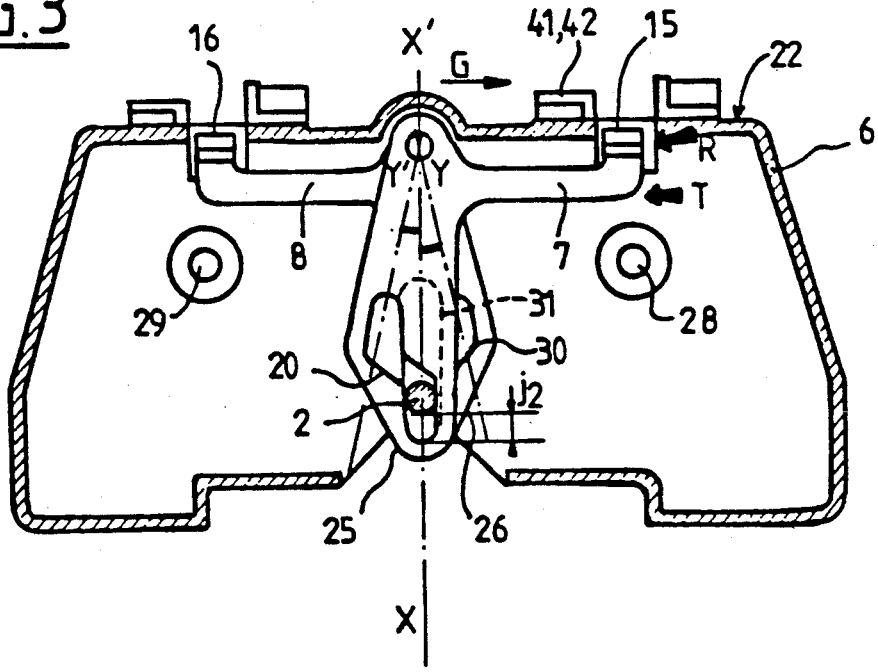
FIG. 3 is an elevational view in section through the same plane, of an adaptation device receiving two auxiliary contact cases having different functions.

As can be best seen in FIG. 3, the adaptation device 4 comprises a hollow case 6 in which two substantially identical levers 7, 8, turned round through 180°, are symmetrically pivoted concentrically about an axis YY'. The pivot may advantageously be formed by a cylindrical rod integrally molded with the case.

Considering the size of the contactor apparatus, the two levers are here used in the same case having matching dimensions whereas a single lever could be used if this size was smaller. Each of the levers 7, 8 comprises two perpendicular arms 9, 11 on each side of the common pivot 12. The arms 9 of these levers 7, 8 have two respective claims 15 and 16, for example, in the form of a dove tail.

The arms of the levers 7, 8 comprise two respective apertures 20 and 30. The latter has general form of an S whose two end portions 17, 18 are connected together by an intermediate central portion 19.

This lever may oscillate by an angle -alpha- during a movement whose origin will be described subsequently and whose amplitude is such that claw 15 may, for example, be engaged by a certain amount in the internal volume 21 of the case for an endmost working position -T- , see FIG. 3. The lever projects by another amount -e- from the surface 22 of the case for an opposite endmost rest position -R- through an opening O, see FIG. 1. The bottom 23 of the case 6 has a recess 24 opposite which the ends 25, 26 of the two levers, appear whereas a lateral wall 27 has two holes 28, 29 accurately located with respect to axis XX' and with respect to an central oblong opening 31 directed towards this axis. This oblong opening has a length -d- which is at least equal to the working stroke of the coupling member 2 which passes therethrough when the case is associated accurately against the lateral face 32 of the contactor apparatus. The accuracy of this association, which is obtained here by means of two threaded openings of this wall such as, for example, 33, 34, see FIG. 1, receiving fixing screws which extend through holes 28, 29 may also use other indexing means well known per se.

During their pivoting movement, the different portions of apertures 20 and 30 move facing the oblong opening 31. These movements will be obtained following substantially rectilinear movements of the coupling member 2 between active and inactive positions, when this member has been fitted into the apertures after passing through the oblong opening when wall 27 thereof is placed against the lateral face 32. Such penetration takes place at the moment when face 6 is associated with the contactor apparatus 1 in the rest condition, see FIG. 2.

Figure 2:
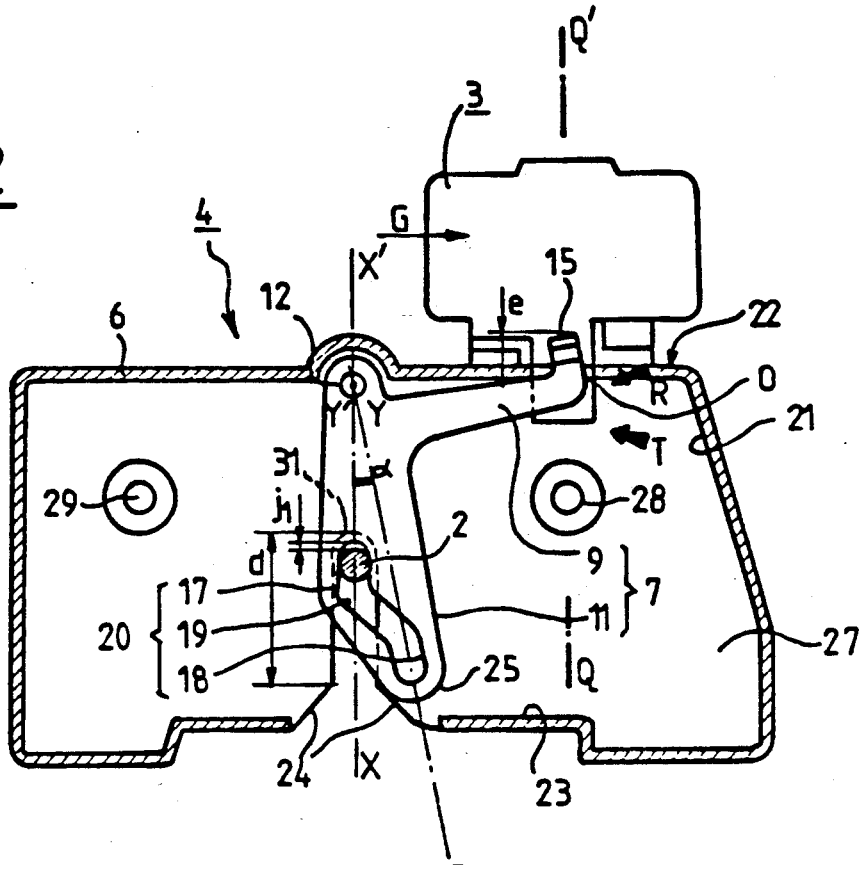
FIG. 2 is a sectional view in elevation through a median plane PP' of an adaptation device for associating a single auxiliary contact case and when the contactor is at rest.

As can be seen in FIGS. 2 and 3, the substantially rectilinear working stroke of the coupling member 2 is less than the total length of each aperture so that, for each of the rest -R- and working -T- positions clearances -j1- and -j2- exist at both ends thereof for said active and inactive positions of the contactor.

As can be seen in these two figures, the angular movements of the levers occur when the coupling member 2 travels in the intermediate inclined portion 19 which connects together the two non aligned portions with substantially rectilinear ends. In practice, it is advantageous to give these endmost portions rectilinear directions convergent towards axis XX' so that the rest and working positions of the levers are well defined even though the amplitude of the working stroke of the control member varies slightly in each of the two active and inactive positions of the contactor.

When, on fitting, so for the de-energized condition of the contactor apparatus, the coupling member must be fitted into the two apertures of the levers, the latter may be moved manually through recess 24 so that alignment occurs more readily allowing such introduction.

Figure 4:
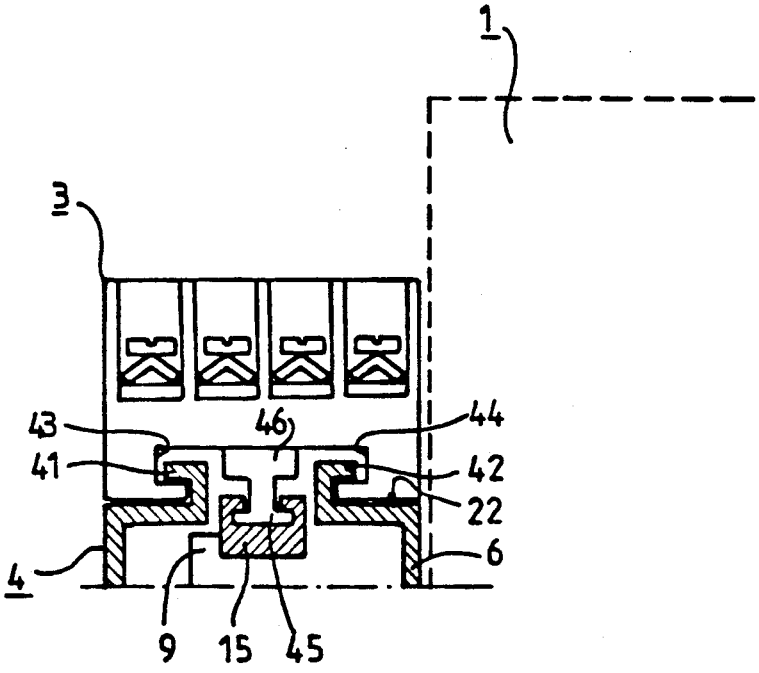
FIG. 4 is a partial sectional view through the plane QQ' of FIG. 2 of an auxiliary contact case coupled to its control lever.

Once associated with the contactor, the different mobile parts are in the rest position shown in FIG. 1 and the projection of claws 15, 16 makes it possible to position an auxiliary contact block which is time delayed or not. Such positioning, which is guided and provided by means of projections 41, 42 placed externally on the surface 22 for engagement in recesses 43, 44 of matched shape, forming part of the case of the auxiliary switches, see FIG. 4, is achieved by a movement in direction -G- substantially parallel to the surface 22, see FIG. 2.

During such movement, claw 15 is engaged about a matched extension 45 belonging to a control rod 46 of the auxiliary switches, for communicating thereto a substantially constant given movement -b-.

Figure 5:
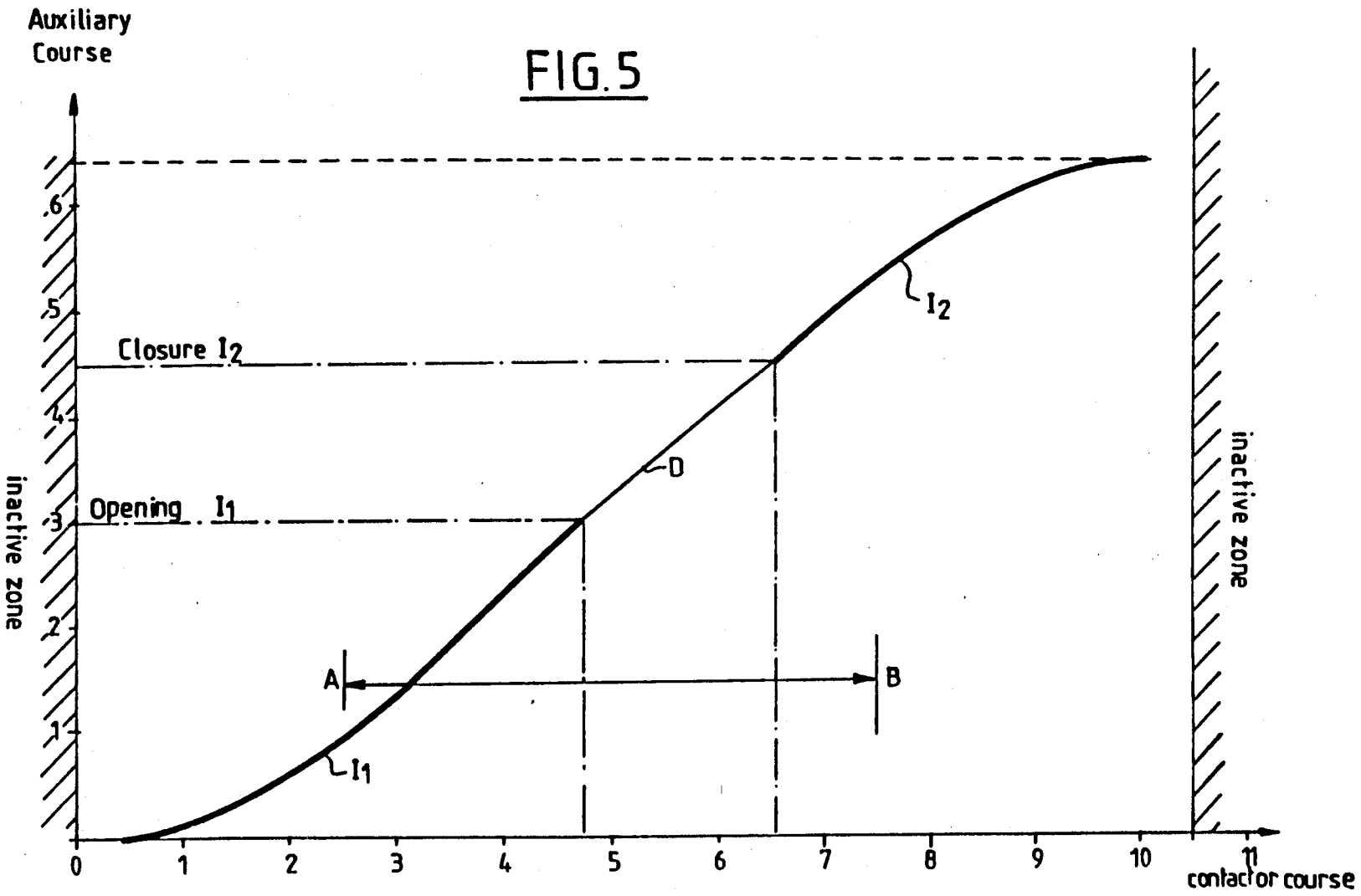
FIG. 5 is a diagram showing the relation between the possible strokes of armatures and that which a mobile contact of the auxiliary switch case must receive.

Referring to the diagram of FIG. 5, where the possible working strokes of the armatures of the different contactor apparatus C1, C2, C3, C4 (or of control parts which might be connected directly thereto) have been shown as abscissa and where the angular movements of the transmission levers have been shown as ordinates, it can be seen that only a central fraction AB of curve D is used for actuating the auxiliary switches, so that considerable variations of manufacturing tolerances can be accommodated.

These precautions are important when auxiliary switches 11, 12 must provide electric locking functions, such for example in the case of circuits reversing the direction of motion of three-phase motors, where it is necessary to prevent overlapping of the energization periods of the two corresponding electromagnet coils, these two switches not having simultaneous closure phases.

What is claimed is:

1. An adaptation device effecting mechanical coupling between a contactor having movable contacts and a first control member simultaneously displaced with said movable contacts, and a switching apparatus comprising a case housing a second control member, and auxiliary switches having movable contacts, said adaptation device further having a housing provided with fixing means so as to be removably fixed in a determined position on said contactor and enclosing a pivotable transmission lever, said lever having an arm provided with an S-shaped groove through which said control member of said contactor is projecting, and a claw projecting from said housing and coupled with the control member of said auxiliary switches, said groove comprising two non aligned endmost portions and an intermediate connecting portion, which forms a ramp on which, when displaced, said control element of the contactor is bearing so as to impart to said lever a rocking movement and hence a predetermined movement of said claw.

2. The adaptation device as claimed in claim 1, wherein said claw projects from a surface of said case by an amount sufficient to allow coupling thereof with said second control member when said movable contacts of said contactor are in a rest position.

3. The adaptation device as claimed in claim 1, wherein the endmost portions of said groove are directed towards the pivoting axis of said lever.

4. The adaptation device as claimed in claim 1, wherein said adaptation device further comprises a further lever for actuating a further switching apparatus, said further lever being identical to said lever and turned round by 180° with respect to said lever, said lever and said further lever being pivoted abut the same axis.

5. The adaptation device as claimed in claim 1, wherein said case is provided with an indentation which is accessible to an operator and the end of the lever adjacent said groove moves opposite said indentation.

* * * * *